US006185840B1

(12) United States Patent
Noelle et al.

(10) Patent No.: US 6,185,840 B1
(45) Date of Patent: Feb. 13, 2001

(54) METHOD AND APPARATUS FOR HARDENING A LAYER ON A SUBSTRATE

(75) Inventors: Lutz Noelle, Weissenhorn; Georg Bolte, Halle, both of (DE)

(73) Assignee: Noelle GmbH, Weissenhorn (DE)

( * ) Notice: Under 35 U.S.C. 154(b), the term of this patent shall be extended for 0 days.

(21) Appl. No.: 08/945,895

(22) PCT Filed: May 6, 1996

(86) PCT No.: PCT/EP96/01872

§ 371 Date: Jan. 26, 1998

§ 102(e) Date: Jan. 26, 1998

(87) PCT Pub. No.: WO96/34700

PCT Pub. Date: Nov. 7, 1996

(30) Foreign Application Priority Data

May 4, 1995 (DE) ..... 195 16 231

(51) Int. Cl.[7] ..... F26B 3/34
(52) U.S. Cl. ..... 34/278; 34/275
(58) Field of Search ..... 34/278, 275, 276; 118/718; 392/407, 417, 419, 421

(56) References Cited

U.S. PATENT DOCUMENTS 3,994,073 11/1976 Lackore .
4,143,278 3/1979 Koch, II .
4,646,446 3/1987 Bubley .

FOREIGN PATENT DOCUMENTS 757249 3/1971 (BE) .
2614663 10/1976 (DE) .
0161540 * 11/1985 (EP) .
0349507 * 1/1990 (EP) .
0589260A1 3/1994 (EP) .
515105 3/1921 (FR) .
2370071 6/1978 (FR) .
2096294 10/1982 (GB) .
63-194779 3/1988 (JP) .

* cited by examiner

*Primary Examiner*—Henry Bennett
*Assistant Examiner*—Malik N. Drake
(74) *Attorney, Agent, or Firm*—Jordan and Hamburg LLP

(57) ABSTRACT

A layer which can be hardened by radiation is located on a substrate surface of paper, glass, plastics, wood or metal. The layer on the substrate, which is guided through a hardening stage, is subjected to radiation with ultraviolet light whilst the lamp chamber is flushed directly with a gas. The layer can be simultaneously tempered and rendered inert or treated in a chemically active manner.

8 Claims, 1 Drawing Sheet

METHOD AND APPARATUS FOR HARDENING A LAYER ON A SUBSTRATE

BACKGROUND OF THE INVENTION

The invention relates to an apparatus for hardening a layer applied to a substrate.

The invention is concerned with the treatment of substances, more especially of dyestuffs, which mainly have a double bond as the monomer, which double bond is to be polymerised by means of UV light. It is known to polymerise double bonds with electrons or cationically.

To enable the UV radiation to start the photo reaction, a so-called photo initiator is needed in the mixture to be treated, e.g. of a dyestuff. This photo initiator is used to excess so that the polymerisation reaction, once started by UV light, is not interrupted by the dyestuff radical reacting with the diradical oxygen. Accordingly, until now, a relatively high concentration of photo initiator is used, so that the likelihood of the dyestuff radical encountering an oxygen radical and being penetrated thereby becomes minimal compared with the likelihood of its encountering another monomer with a double bond and radicalising such monomer.

Central cylinder machines are known with which various dyes are applied one after the other to a paper web or to a plastics material film, each layer being dried before the next dye layer is applied. UV emitters are used, and cooled by means of air, to dry these individual dye layers. For this, a UV lamp with an external temperature of approx. 800° C. is cooled by the induction of air which is conducted past the lamp The disadvantages in this arrangement are the constant production of ozone, the movement of large quantities of dirt particles and the heating of the coated substrate which, especially with heat-sensitive plastics material films, can lead to serious imperfections.

Alterations to the known cooling system by water-cooling around or in front of the UV lamp lead to performance losses. Meanwhile, arrangements with a water-cooled housing and reflector and possibly also with a water-cooled counter-pressure cylinder are being used successfully. This structural arrangement is indeed usable in heat technology; no dirt particles are moved and no ozone is produced, but large performance losses are to be expected with a water-cooling system which encases the UV lamp.

Since, in fact, the photo initiators have the disadvantage of, on the one hand, having a relatively strong inherent smell arid, on the other hand, being very expensive, the technical problem of the invention resides in producing an apparatus in which the quantity of photo initiators can be considerably reduced.

According to the invention, this problem is solved with an apparatus according to the claims.

SUMMARY OF THE INVENTION

According to the invention, in the case of printing ink, the dyestuff comprising a maximum of only 20% photo initiators is applied to an aluminium foil or plastics material film, or respectively a paper web, and hardened/dried by means of UV light, two essential steps being taken. The first step resides in the fact that the film, which is generally very heat-sensitive and is between 10 and 50 $\mu$m thick, has to be cooled during the UV irradiation. However, the present invention does in fact reside in effecting the second step, i.e. carrying out the printing and drying/hardening operation in an atmosphere of scavenging gas. If inert gas is used, nitrogen or carbon dioxide is preferred.

The scavenging gas does not necessarily have to be an inert gas, but it may also be dry air, moist air or a different reactive gas, depending on the layer to be hardened. For example, there are chemical systems which are not sensitive to oxygen but are sensitive to moisture. If, however, adhesives are applied to a paper web or a plastics material film, or respectively an aluminium foil, for example, said adhesives require water in order to be able to react better and to harden. A polyamide film, however, is inclined to bond a considerable amount of moisture to the surface. As a result, the gas must be selected in such a way that this film has the moisture removed before the printing operation, that is to say before the dye is applied, so that substantially more advantageous conditions prevail than is the case if the dye is applied to a monomolecular film of moisture.

The proposal according to the invention can be used with particular advantage in a flexo-printing cylinder machine working at high speed, on which machine, for example, films for food packaging are produced or laminating must be performed. It allows not only a remarkable adhesion of dye on paper/plastics material films or on aluminium foils, but the previously serious problem of the unpleasant odour is also removed by the considerable reduction in the number of photo initiators, because the hardening/drying of the individual dye layers now occurs in a protected atmosphere and rapidly. The laminar flow, including oxygen, can, more especially, also be replaced by nitrogen before the substrate is passed to the hardening stage in the form of the UV drier, the dye on the surface also being released by the quickly absorbed oxygen. According to the invention, therefore, up to more than 80% of the photo initiators previously required can be eliminated, so that considerable savings are also made with the UV hardening printing inks.

The invention is explained more fully hereinafter by embodiments with reference to the accompanying drawing.

DETAILED DESCRIPTION OF THE INVENTION

Figure 1:
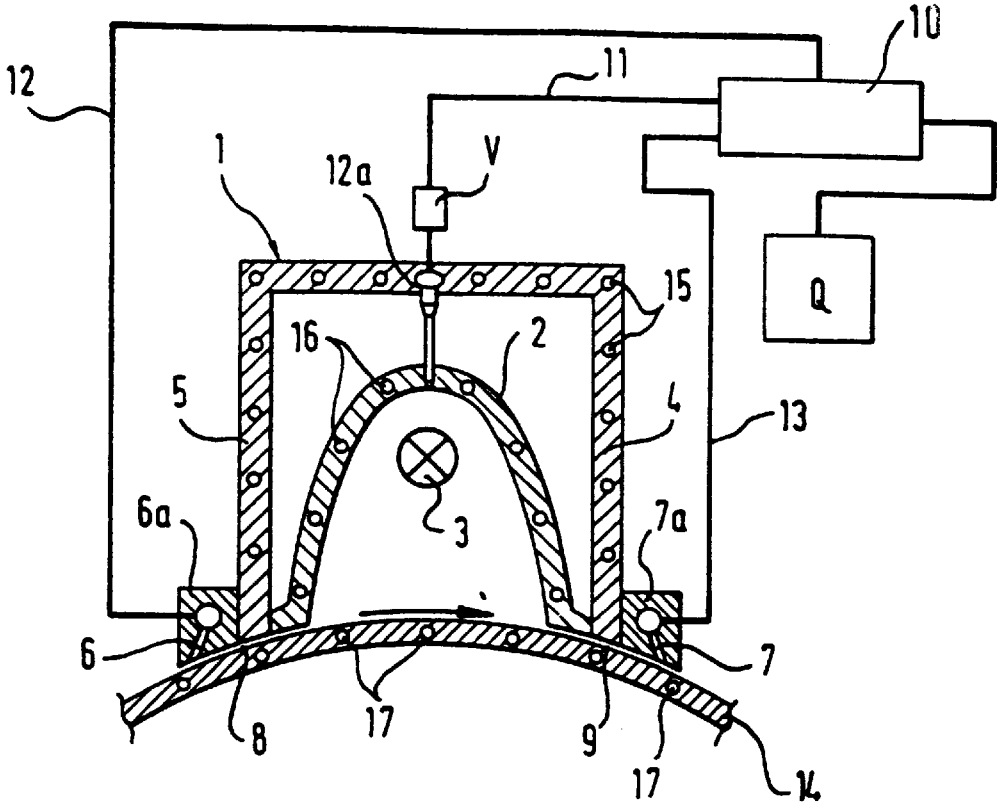
FIG. 1 is a schematic illustration of an apparatus for hardening a layer on a substrate, viewed in the axial direction of a cylinder conveying the coated substrate.

As shown in FIG. 1, a housing 1 having lateral walls 4 and 5 is provided. This housing is open at its lower end which is orientated towards a counter-pressure cylinder 14, which is a hollow cylinder and the wall of which comprises coolant passages 17 through which water, for example, can flow. While the lateral wall 5 defines a gap 8 with the cylinder surface, a gap 9 is provided in FIG. 1 on the right-hand side between the lateral wall 4 of the housing 1 and the surface of the counter-pressure cylinder 14; the two gaps 8 and 9 are approximately 2 mm wide in the embodiment shown. The rotating cylinder conveys a substrate which has been coated with a layer before passing into the housing 1 for the hardening stage.

Nozzle bodies 6*a* and 7*a* are provided on the outer faces of the lateral walls 4 and 5, gaps 6 and 7 also being provided between these nozzle bodies 6*a* and 7*a* and the surface of the counter-pressure cylinder conveying the substrate, said gaps corresponding in width to the gaps 8 and 9.

Inside the housing 1 there is a reflector 2, which is curved in its upper region and directs the rays of a UV lamp 3 directly onto the traversing substrate, in order to dry, or respectively harden, the layer applied to the substrate. Both the housing 1 and the reflector 2 are penetrated by coolant ducts 15 and 16, so that these parts can be temperature-controlled or respectively cooled, when a cooling medium, preferably water, is circulated through these ducts 15 and 16.

A scavenging gas source Q is provided which supplies a scavenging gas to the hardening stage or respectively removes such therefrom. For this purpose, a scavenging gas pipe 11 extends from the scavenging gas source Q via a gas flow and quantity regulator 10 through an aperture 12*a* in the upper housing wall and terminates in a nozzle provided in the reflector 2. Thus the scavenging gas can scavenge the area below the reflector 2 and emerge from gaps 8 and 9. Furthermore, an additional scavenging gas pipe 12 extends from the gas flow and quantity regulator 10 to the nozzle body 6*a,* so that scavenging gas is also directed through the nozzle gap 6 onto the incoming substrate, the conveying direction of which is indicated in FIG. 1 with an arrow.

An additional scavenging gas pipe 13 leads from the gas flow and quantity regulator 10 to the nozzle body 7*a* and communicates with the nozzle gap 7. In this way, the scavenging gas can also act on the substrate at the outlet side thereof, more especially on its applied layer. The scavenging gas from the nozzle gap 7 has an additional effect, in that it produces a reduced pressure in the area surrounded by the reflector 2 and removes any scavenging gas, which is present there, through tie outlet gap 9. The magnitude of this reduced pressure can be adjusted by the regulator 10 and a valve V, which is disposed in the scavenging gas pipe 11. Such a suction effect can also be produced from the nozzle gap 6, out of which scavenging gas is directed not only onto the layer of the incoming substrate. It is preferable to make the nozzle gaps 6 and 7 adjustable in respect of their inflow angle, as is described below. Although the nozzle bodies 6*a* and 7*a* are respectively situated on the external face of the lateral walls 4 and 5 in the embodiment shown, it is also possible to incorporate these bodies in the lateral walls.

Figure 2:
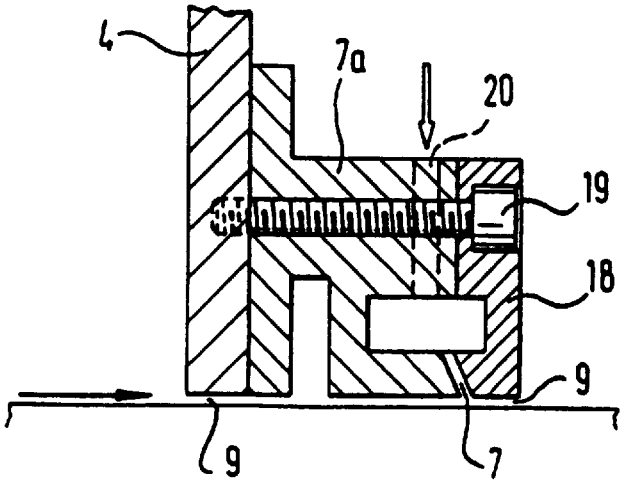
FIG. 2 is a partial view of the external lateral wall with nozzle bodies disposed thereon.

As shown in FIG. 2, a nozzle body 7*a* is provided in the region of the lower portion of die lateral wall 4, which nozzle body operates simultaneously as a light guard and is glued and screwed to the lateral wall. The nozzle gap 7 is produced by an additional nozzle body 18 being retained on the nozzle body 7*a* by means of an adjusting screw, this adjusting screw having an enlarged head, the inner edge of which abuts against a stepped portion of the nozzle body 18. The nozzle gap 7 is adjustable in its width according to how deeply the adjusting screw 19 is screwed in position. Scavenging gas is supplied to this nozzle gap 7 via a duct 20 which is flow-connected to the scavenging gas pipe 13. In FIG. 2 the direction of movement of the substrate, not shown in detail, is indicated by an arrow, the substrate being guided through the gap 9 between the nozzle body 7*a* and the counter-pressure cylinder.

If it is desirable to direct scavenging gas over the substrate and subsequently to extract it from the area below the reflector, the scavenging gas pipe 11 is set to suction mode by switching-over the regulator 10, while the two scavenging gas pipes 12 and 13 conduct the scavenging gas to tie nozzle bodies 6*a* and 7*a*. In other words, it is possible to choose to have the scavenging gas pipes 11, 12 and 13 working as pressure or respectively suction pipes depending on the substrate to be treated.

EXAMPLE

The reduction of conventional photo initiator components to approx. 20% normally means an inadequate cross-ing reaction of the printing ink. If, however, the oxygen in the air (approx. 24%) is displaced by nitrogen (approx. 75%) for the most part, no extremely reactive molecules are available for the polymerisation reaction of the photo initiator/bonding agent combination. Since the UV dye absorption must be effected with oxygen-collectors, this is largely unnecessary with an oxygen reduction.

a) V=80 m/min (web velocity) 20% of the conventional initiator concentration, low UV lamp power of approx. 50 W/cm→deposition of the dye on guide rollers.

b) identical conditions, but with a nitrogen scavenging step between printing ink application and UV radiation→hard-dried, no deposit discernible on guide rollers. (web velocity).

The two comparative tests show a great saving potential for the most expensive absorbing component (initiator), reduction of the odour effects and a better cross-linking with a smaller migration tendency.

A relatively high direct radiation angle means a correspondingly high performance output of the UV light with the disadvantage of possibly heating the substrate which is, however, compensated-for by corresponding cylinder cooling. The reflected rays have been reflected on a water-cooled reflector system. At the same time, the housing is cooled and the interior can be filled with gas such as, for example, nitrogen.

The conventional light guards for the protection of personnel are configured in such a way in the embodiment shown that they work as a gas nozzle at the same time. To achieve a "peel effect", the angle for setting the gas nozzle is adjustable depending on the substrate surface. Furthermore, a zonal cover is possible in order, for example, to use less gas with narrower substrate widths. The gas supply is programmed according to automatic control technology via the travel mode of the system. The so-called light and gas scavenging bar can be operated independently of the UV emitter unit, i.e. before a printing station to clear a rough surface of oxygen before the application of ink.

The combination of a gas scavenging, e.g. before the UV emitter and a suction after the UV emitter makes possible a regulated gas circulation which can be increased if desired. This example can be used, according to the invention, for example, with treated air (moisture content). This case is of interest for a water-catalysed reaction.

As further examples for the intended application of gassing reactions, reference is made to:

1. PVA/water/ammonium chromate.

For the production of coatings having polyvinyl alcohol dissolved in water or even alternatively dissolved polyvinyl pyrrolidone, a photo initiator based on diazonium salt or even ammonium chromate $(NJ_4)_2Cr_2O_7$ is used. The coating substance is applied, dried and exposed to UV light with residual moisture in the film layer. This reaction is greatly influenced by the residual moisture and the pH value in the film and is effected, according to the invention, by a treatment with a specific gas moisture and a specific $CO_2$ content, e.g.: in a nitrogen scavenging operation. A field of application for this reaction is, for example, the production of screens for colour television tubes (literature:

1. G. Bolte in Farbe und Lack, $88^{th}$ year July 1982, Pp. 528–533;

2. J. C. Colbert, Modern Coating Technologie, Noyes Data Corp., 1982, P. 128 et seq.).

2. Further gas scavenging possibilities can be reaction intensifications or respectively reaction cutouts by, for example, an appropriate pH value adjustment:

isocyanate reaction isocyanates (solid phase)+alcohols (vapour phase) →polyurethanes pH value adjustment:

ammonia, $H_2COOH$, e.g. enriched in inert gas ($N_2$).

For these variants, the use of supplying or discharging gas in the UV emitter is significant when combined with controlling the gas composition.

The quantity of the scavenging gas, which is pressure-controlled in the region of the hardening stage and is supplied and discharged again, can be controlled in dependence on the substrate velocity and/or on one or more measurement parameters. As measurement parameters, for example, reference is made to the following:

a) measuring the oxygen on the substrate surface for regulating the quantity of nitrogen, b) determining the differential pressure to achieve specific excess gas pressure within the hardening area;

c) measuring the temperature of the gas to determine the cooling effect and also to regulate the quantities of scavenging gas;

b) measuring the concentration of chemical ingredients in the scavenging gas, such as water vapour, $CO_2$ and others.

One example of use is the achievement of a specific degree of shine for lacquers by altering the power of at least two UV lamps situated behind one other when viewed with respect to the direction of travel of the substrate and by appropriately altering the residual quantity of oxygen during the actual transit through each respective lamp.

We claim:

1. Apparatus for hardening a substance on a substrate comprising:

a housing having cooling ducts therein:

a source of UV light being disposed internally of the housing, a reflector for directing the UV light being disposed internally of the housing and interposed between the housing and the source of UV light the reflector having cooling ducts therein:

a transporting body being disposed adjacent the housing for transporting the substrate with the substance thereon relative said housing, the transporting body having cooling ducts therein for cooling the substrate, the housing being open in a direction towards the transporting body, whereby the UV light being directed by the reflector is directed onto the substrate, the transporting body and the housing defining a substrate inlet gap at one end of the housing between the housing and the transporting body, the transporting body and the housing defining a substrate outlet gap at another end of the housing between the housing and the transporting body, whereby the transporting body, when transporting the substrate in the proximity of the opening in the housing, transports the substrate through the substrate inlet gap to the opening in the housing and transports the substrate through the substrate outlet gap out of the opening in the housing;

at least one first scavenging gas pipe connected at one end to a scavenging gas source and at another end to an interior of the housing via a nozzle;

an inlet scavenging gas nozzle provided on the housing adjacent the substrate inlet gap;

an outlet scavenging gas nozzle provided on the housing adjacent the substrate outlet gap, the inlet scavenging gas nozzle and the outlet scavenging gas nozzle having flow direction angles which are adjustable relative to the substrate, during transport thereof; and a gas flow direction and quantity regulator connected to the scavenging gas source, the inlet scavenging gas nozzle and the outlet scavenging gas nozzle being flow-connected to the gas flow direction and quantity regulator.

2. Apparatus according to claim 1, further comprising at least one second scavenging gas pipe being connected at one end to the gas flow direction and quantity regulator and at an another end to the inlet scavenging gas nozzle, and at least one third scavenging gas pipe being connected at one end to the gas flow direction and quantity regulator and at an another end to the outlet scavenging gas nozzle; wherein the inlet scavenging gas nozzle and the outlet scavenging gas nozzle are situated outside the housing, so that gas scavenging of the substrate occurs both before and after the substrate has traversed the opening in the housing.

3. Apparatus according to claim 1, wherein the inlet scavenging gas nozzle and the outlet scavenging gas nozzle are provided as light protective screens which are adjustably disposed on the external sides of the housing.

4. Apparatus according to claim 2 or 3, wherein the first, second and third scavenging gas pipes from the regulator are selectively switchable as gas suction pipes or gas feed pipes by the regulator.

5. Apparatus according to claim 1, wherein the apparatus is disposed as a component part of a central cylinder machine on the periphery of a central cylinder and is respectively connected to the output end or the input end of a coating mechanism.

6. Apparatus according to claim 1, further comprising a water-cooled shutter plate being provided in the housing, which is displaceable between the source of UV light and the substrate.

7. Apparatus according to claim 1, wherein the substance on the substrate is selected from the group consisting of printing ink, lacquer, adhesive and silicone, and the substrate is selected from the group consisting of paper, plastics, glass, wood and metal.

8. Apparatus according to claim 1, wherein the inlet scavenging gas nozzle and the outlet scavenging gas nozzle are water-coolable.

* * * * *